US006923639B2

(12) United States Patent
Pesu et al.

(10) Patent No.: US 6,923,639 B2
(45) Date of Patent: Aug. 2, 2005

(54) FLAME-RESISTANT WICK HOLDER FOR CANDLE

(75) Inventors: Bradley D. Pesu, Gahanna, OH (US); Joseph P. Romano, Worthington, OH (US); Fabian Destefano, Powell, OH (US); Cheriyan B. Thomas, New Albany, OH (US)

(73) Assignee: Bath & Body Works, Inc., Reynoldsborg, OH (US)

( * ) Notice: Subject to any disclaimer, the term of this patent is extended or adjusted under 35 U.S.C. 154(b) by 0 days.

(21) Appl. No.: 10/388,038

(22) Filed: Mar. 13, 2003

(65) Prior Publication Data

US 2004/0033464 A1 Feb. 19, 2004

Related U.S. Application Data

(63) Continuation-in-part of application No. 10/257,201, filed as application No. PCT/US02/26313 on Aug. 16, 2002, now abandoned.

(51) Int. Cl.[7] ..... F21V 35/00; C11C 5/00

(52) U.S. Cl. ..... 431/35; 431/288; 431/289; 431/291; 431/325

(58) Field of Search ..... 431/288, 299, 431/289, 33, 35, 325

(56) References Cited

U.S. PATENT DOCUMENTS

| | | | | | |
|---|---|---|---|---|---|
| 574,376 | A | * | 1/1897 | Baumer | 431/291 |
| 1,660,760 | A | * | 2/1928 | Murphy | 40/541 |
| 1,842,904 | A | | 1/1932 | Greenan | |
| 1,867,420 | A | * | 7/1932 | Root | 431/291 |
| 2,291,072 | A | | 7/1942 | Dahle | |
| 2,775,882 | A | | 1/1957 | Doig | |
| 3,041,707 | A | * | 7/1962 | Perri | 428/96 |
| 3,583,853 | A | | 6/1971 | Schramm | |
| 4,134,718 | A | * | 1/1979 | Kayfetz et al. | 431/125 |
| 4,239,678 | A | * | 12/1980 | Williams | 524/159 |
| 5,927,312 | A | | 7/1999 | Dryden et al. | |
| 6,361,311 | B1 | * | 3/2002 | Smith | 431/291 |
| 6,508,644 | B1 | * | 1/2003 | Pesu et al. | 431/35 |

FOREIGN PATENT DOCUMENTS

| | | | |
|---|---|---|---|
| CA | 2243351 | | 7/1998 |
| DE | 2415652 | | 10/1975 |
| DE | 3630712 | | 3/1988 |
| DE | 41 39 713 | * | 6/1993 |
| DK | 647 | | 3/1895 |
| FR | 1423888 | | 11/1964 |
| FR | 2715995 | * | 8/1995 |
| GB | 2 070 114 | * | 9/1981 |
| JP | 2 402021504 | | 1/1990 |
| JP | 08-157864 | * | 6/1996 |
| JP | 9 409265831 | | 10/1997 |
| JP | 10-330782 | * | 12/1998 |
| JP | 2000-8076 | * | 1/2000 |
| JP | 12 2000-038592 | | 8/2000 |
| WO | WO 92/13052 | * | 8/1992 |
| WO | WO 97/30138 | | 8/1997 |
| WO | WO 99/23416 | * | 5/1999 |
| WO | WO 02/33315 a1 | * | 4/2002 |

* cited by examiner

*Primary Examiner*—Carl D. Price
(74) *Attorney, Agent, or Firm*—Notaro & Michalos, P.C.

(57) ABSTRACT

A flame-retardant wick holder for a candle is made of a material having a UL-94 vertical burn test rating of at least V-0, including polymers and ceramics. The wick holder supports a wick at the bottom of a candle. The wick holder material causes the flame on the wick to extinguish when it reaches the holder, thereby preventing flashover of the residual candle fuel at the end of the candle useful life. One version of the holder has a cylindrical sleeve fit over a wick clip holding the lower end of the wick. The cylindrical holder is well adapted for use in pillar-type candles.

18 Claims, 11 Drawing Sheets

FLAME-RESISTANT WICK HOLDER FOR CANDLE

CROSS REFERENCE TO RELATED APPLICATIONS

This application is a continuation-in-part application of U.S. patent application Ser. No. 10/257,201 filed on Oct. 9, 2002, now abandoned, which is the National Phase of International Application PCT/US02/26313 filed Aug. 16, 2002, which claims priority of U.S. patent application Ser. No. 10/131,943 filed Apr. 25, 2002, now U.S. Pat No. 6,773,484, which is a continuation-in-part application of U.S. patent application Ser. No. 09/931,826 filed Aug. 17, 2001, now U.S. Pat. No. 6,508,644, the entirety of each of which is hereby incorporated by reference.

FIELD AND BACKGROUND OF THE INVENTION

The present invention relates generally to the field of candle making and in particular to a new and useful holder for a wick which extinguishes the candle flame at the end of the candle useful life.

Candle wicks function by capillary action drawing a fuel from a pool up through the wick to the flame. The fuel used in known candles may be paraffin wax, vegetable-based wax or synthetic polymers, like ester-terminated polyamides (ETPA), such as one sold under the name UNICLEAR, or PENRECO gel sold by Pennzoil. Paraffin waxes typically form a melt pool at between 150–200° F., while UNICLEAR polyamide forms a melt pool at between about 200–250° F. The capillary action can be through a fabric or thread wick or through a capillary tube. When the candle fuel pool becomes very shallow, it can become hot enough to vaporize and it no longer needs a wick to burn. This phenomenon is called "flash" or "flashover" and is a problem especially with candles formed or supported in containers.

Once the upper surface of the wax descends nearly to the floor of the container, the shallow pool of wax can be elevated above its flashpoint temperature, typically between 350–450° F. for conventional paraffin waxes and about 440° F. for UNICLEAR, for example. During flashover, the temperature within the candle can be elevated to at least 1200° F. This excessive heat can cause glass containers to break, and it can cause metal tins to scorch the paint off the tin sides and char surfaces on which they are resting. With freestanding candles the molten wax pool must not extend through the candle floor, because wax can flow out onto the candle supporting surface. If the wax flows out or the container of a contained candle breaks, supporting or surrounding objects can be ignited.

An additional problem is that carbon balls may form during burning and fall into the wax pool at the bottom of the candle, or the user may allow matches or wick trimmings to fall to the bottom. These foreign objects may aggravate the flashover problem by becoming secondary wicks if they are ignited by the candle flame.

In conventional candles formed in containers, a wick support like the sustainer 2 shown in FIG. 1, is often used to provide lateral support to a wick in a candle to hold the wick in place during pouring of the wax or other fuel. The sustainer 2 also keeps the wick standing upright when the supporting wax around the wick burns very low. The wick is held in a bore formed completely through the sustainer.

Sustainers of this type are popular for use in candles because they are easily assembled using machines. The wick is simply inserted through the bore and held in place by crimping the bore. The cylindrical plate of the sustainer 2 is easily affixed to a container for holding a candle.

During burning, molten wax 4 is drawn upwardly through the wick sides initially, and is carried to the flame. As the upper surface of the molten wax 4 descends to near the top end of the sustainer 2, the heat from the flame liquifies the wax all around the sustainer 2. Once this wax is liquified, molten wax 4 can be drawn from beneath the sustainer 2 through the bore and upwardly to the flame. This permits the majority of the wax 4 to be consumed before the flame goes out from lack of fuel. When the depth of the molten wax 4 is sufficiently small, the flashover problem can occur.

Flashover is a problem which causes significant damage and harm. Flashover can result in house fires and burns to people who use candles decoratively. This is a problem which is being given more attention by consumer groups and needs to be solved in an economical way. The need exists for an inexpensive and simple safety device for preventing or significantly decreasing the likelihood of flashover.

Several different approaches to solving the problem of flashover have been provided. U.S. Pat. No. 5,842,850, for example, discloses several embodiments of a wick sustainer of the type shown in FIG. 1 having the bottom end of the sustainer sealed against permeation by a candle fuel. The sealed bottom prevents molten candle fuel from being drawn through the wick in the bore of the wick sustainer, causing the candle to extinguish when the fuel level drops below the level of the exposed wick above the wick sustainer.

U.S. Pat. No. 4,332,548 teaches a transparent safety disc at the bottom of a candle. The safety disc is formed by a thermoplastic polyamide resin, combined with a flammable solvent for the resin that is compatible with the candle material. The candle is also transparent. A wick holder and wick are placed on a layer of the resin mixture followed by pouring the candle material around the wick and wick holder and over the resin layer. The safety disc layer helps prevent flameups due to its higher melting point and other characteristics which render it substantially non-flammable in the presence of a candle flame.

U.S. Pat. No. 3,797,990 discloses a safety layer for a candle formed from a higher melting point wax. The higher melting point wax in the safety layer is not combustible by a candle flame. The safety layer may be positioned around or below the wick clip and wick bottom. When the candle flame nears the safety layer and causes it to melt, the wax in the safety layer begins to block the wick, subsequently resulting in the candle flame being extinguished due to lack of fuel.

U.S. Pat. No. 2,831,330 teaches adding polybutene polymers to a candle wax in different proportions to first extend the burn time of the candle and then in an amount sufficient to extinguish the candle due to lack of fuel. Polybutene polymer provided in concentrations of about 15% in a portion of a candle is disclosed as being capable of extinguishing a candle when the candle flame reaches the area of higher polybutene concentration.

U.S. Pat. No. 5,127,922 describes a candle having an outer shell which includes 10–30% of a fire retardant material. The fire retardant material is mixed with a thermoplastic compound, so that the shell will slowly melt and mix with the candle fuel as the candle burns. The fire retardant can be a silicone elastomer, a non-halogenated, inorganic flame retardant or an alumina trihydrate, among other compounds.

Other mechanical devices for extinguishing a candle prior to the point where a flashover or flame-up would occur are known, such as taught by U.S. Pat. No. 4,818,214 for a candle having a heat-shrinkable sleeve around the candle near the base. When the candle burns down sufficiently that the candle flame is near the sleeve, the heat activates the sleeve, causing it to shrink inwardly, constricting the wick and extinguishing the flame.

Several of the prior art devices and compounds use flame retardants or flame-resistant materials to extinguish the flame. But, the prior compounds and apparatus for preventing flashover or extinguishing a candle flame can be complex and require particular mixtures of components. Further, some prior art flame-retardant coatings and mixtures for use on wicks or in candle fuels can also make the candle difficult to use by extinguishing the candle prematurely and requiring relighting well before the end of the useable life.

Polyethylene discs with central bores for holding wicks have been suggested for use as the wick holder in a candle to prevent flashover. However, testing has revealed that polyethylene discs soften at 200° F. and can combust rather easily when exposed to a burning candle flame. Thus, polyethylene, while easy to mold, is not suitable for providing a non-combustible wick holder for extinguishing a candle flame at the end of the candle useful life.

Clearly, few simple solutions for preventing flashover which are easy to manufacture and incorporate into a candle are available.

A flame-resistant and retardant wick holder which can be easily incorporated into candles in place of existing wick sustainers is needed. Plastics are a material which can be easily molded and formed, but which can also combust and produce very toxic by-products.

A widely accepted test to determine flammability of plastics used in products is found in Underwriter Laboratories UL-94 standard. ASTM standard 3801-96 and ISO standard 1210-1991 are similar standards having similar tests and equivalent ratings.

The UL-94 standard includes horizontal and vertical burn tests which can be used to rate the flammability of plastics. The vertical burn test is considered more stringent and a plastic can receive one of several ratings, depending on its flammability.

A rating of V-0 from the UL-94 vertical burn test indicates that combustion of the product stops within ten seconds after two applications of ten seconds each of a flame to a test bar of the plastic material, and the material must not produce any flaming drips. The V-0 rating is considered the best rating of non-flammability for a plastic.

The UL-94 vertical burn test is performed by suspending a ½ inch wide by 5 inch long test rod of the plastic material over a cotton pad. A burner flame is applied to the lower end of the test rod for ten seconds, following which combustion of the rod, if any is observed until it stops. The burner flame is applied to the test rod for a second period of ten seconds. Observations of the test rod following application of the flame determine the rating the material will receive. In addition to the requirements noted above, the specimen must not begin glowing or flaming combustion after application of the burner flame. The rating for the material is based on the thickness of the test rod used. That is, a ¼ inch thick test rod which achieves a V-0 rating qualifies the material of the test rod used in products in ¼ or greater thicknesses. The thinner the test rod, the less combustible the material.

Polyethersulfone (PES) is one such material which has a V-0 rating for the UL-94 vertical burn test at a thickness of 0.8 mm, or about 1/32 inches. Polyethersulfone is a thermoplastic material which is commonly used for electrical applications such as wire insulation, connectors, molded interconnects and housings for starters. Polyethersulfone is also known for use in other applications as well where heat resistance is desired. However, while the combustion characteristics of polyethersulfone are known, PES is not known for use in applications involving open flames.

SUMMARY OF THE INVENTION

It is an object of the present invention to provide a non-combustible wick holder for a candle to eliminate flashover.

It is a further object of the invention to provide a wick holder which will extinguish a candle flame on a wick when the flame reaches the wick holder.

Yet another object of the invention is to provide a non-flammable wick holder that is easily incorporated into a candle for preventing flashover of the candle when the wick burns down to the wick holder.

Accordingly, a flame-retardant wick holder for a candle wick is provided which effectively extinguishes the candle flame on the wick when the flame and fuel level reach the wick holder. The flame-retardant wick holder is a disc or sleeve made of a polyethersulfone with a bore through the center for holding a candle wick.

In one embodiment, the top surface of the disc may be sloped away from the bore in the center, so that the top surface has a conical shape, or it may be flat. Further, a vertical barrier or ridge may be provided extending upwardly from all around the outer edge of the disc. The barrier has grooves or through-holes for permitting molten wax to drain off the sloped top surface of the disc.

The wick holder may have a diameter or width the same as the container it is used in, or it may be as small as about one inch across. The wick holder may be shaped to accommodate the shape of the container, or it is circular.

In an alternate embodiment, the wick holder is formed as a cylindrical sleeve fitted over a wick clip securing a wick. The upper end of the wick holder sleeve extends past the upper end of the wick clip tube. This embodiment is particularly useful in pillar type candles which are free-standing and do not have a surrounding container.

In each case, the wick holder is sufficiently thick, or shaped to have a maximum height, so that the upper end of the bore is raised above the floor of the container or support where the disc or sleeve is used to prevent candle fuel from melting and rising through the wick in the bore.

The polyethersulfone (PES) used to make the wick holder is selected from those having a UL-94 vertical burn test rating of at least V-0 or which is non-combustible and intumescent when heated. The intumescent property of PES helps restrict the flow of candle fuel through the wick, as the PES swells from the greater heat of the candle flame burning closer to its upper surface. The swelling polymer constricts the wick within the holder bore, thereby cutting off the capillary flow of candle fuel. And, since the wick holder is substantially non-combustible, it will not support combustion once the flame reaches its surfaces. Other polymers which are also non-combustible and intumescent like polyethersulfone can be used to make the wick holder with similar effect.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
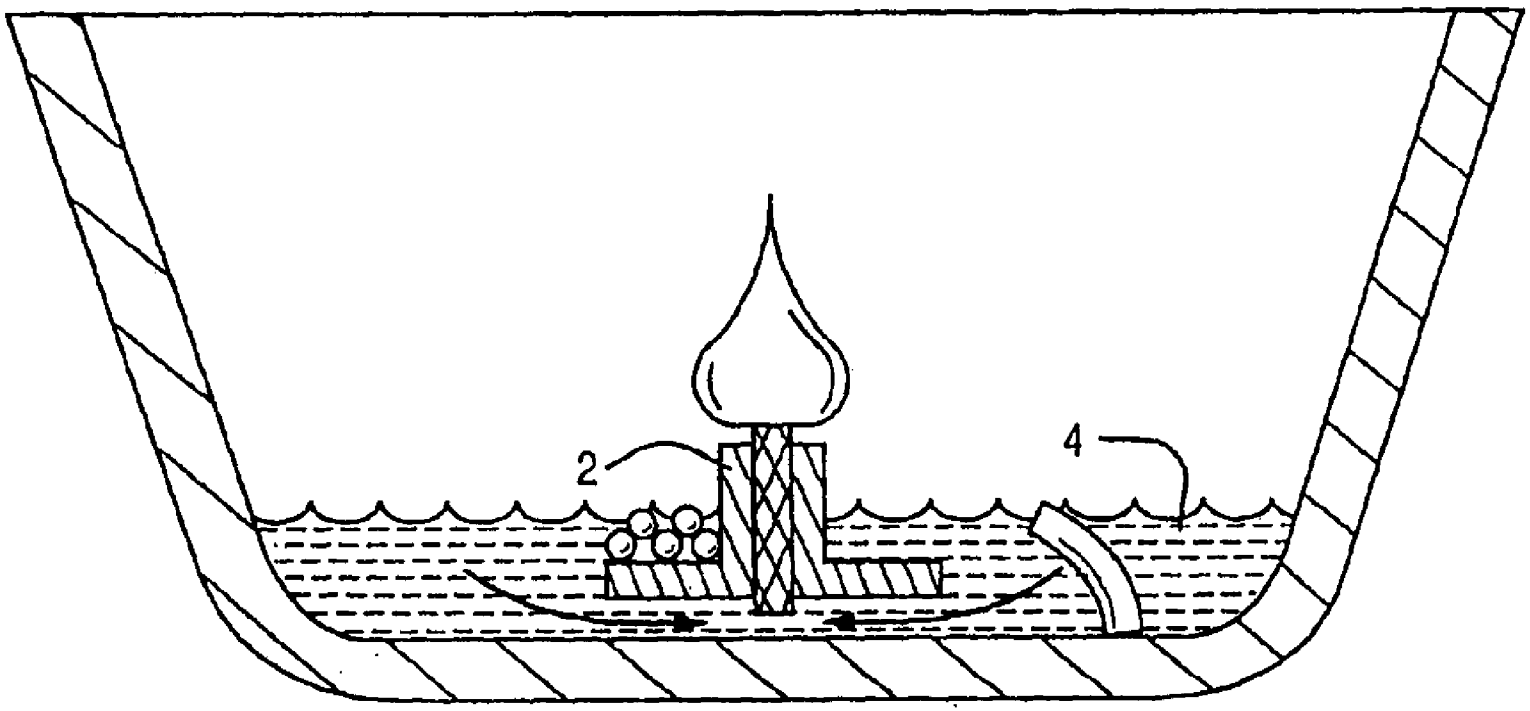
FIG. 1 (PRIOR ART)
FIG. 1 is a side sectional view of a prior art candle and wick holder.
Figure 2:
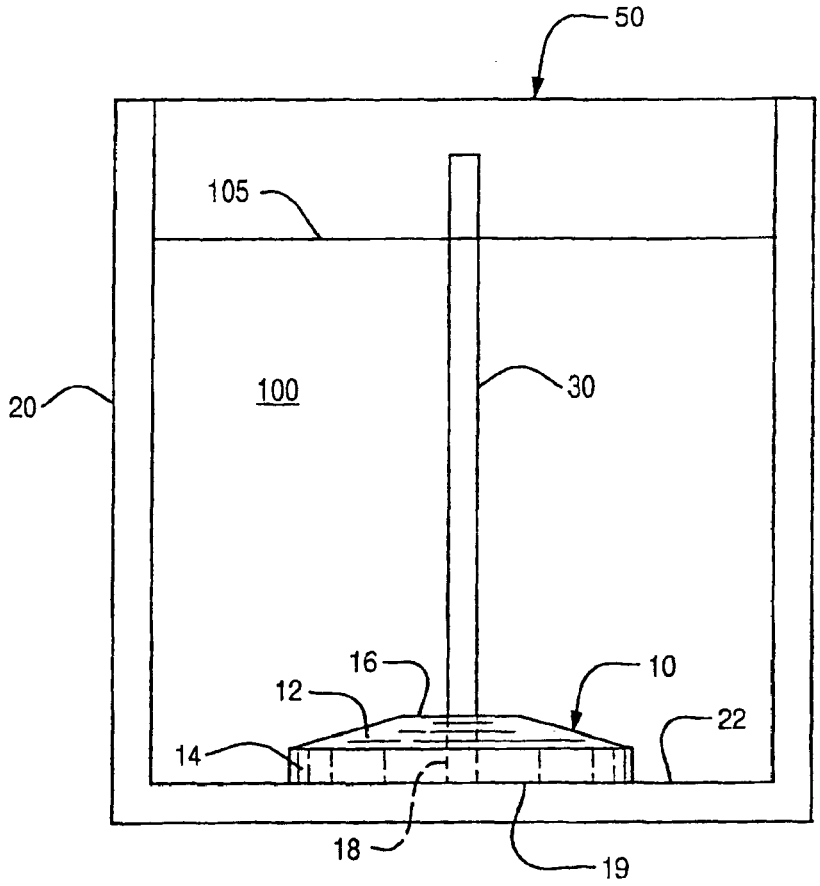
FIG. 2 is a partial sectional side elevation view of a candle having a wick holder according to the invention.

Referring now to the drawings, in which like reference numerals are used to refer to the same or similar elements, FIG. 2 shows a sectional view of a filled candle 50 formed by a container 20 holding candle fuel 100 around wick 30. Wick 30 extends through the candle fuel 100 from the fuel top surface 105 to the container floor 22. The lower end of the wick is inserted through bore 18 of a disc-shaped wick holder 10.

Figure 3:
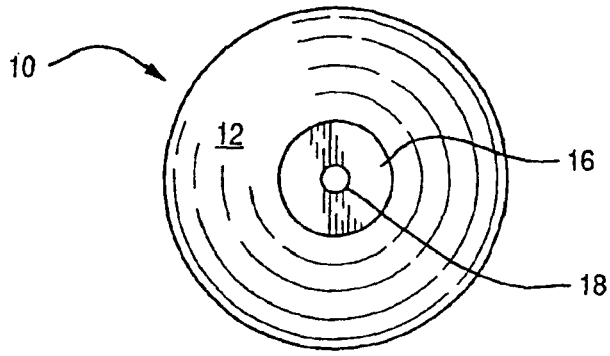
FIG. 3 is a top plan view of the wick holder of FIG. 2.

As seen in FIGS. 2 and 3, the wick holder 10 has a cylindrical base 14, a sloped upper surface 12 and a horizontal top surface 16. The bore 18 extends vertically through the wick holder 10 between the horizontal top surface 16 and the holder bottom 19. The wick 30 can be held within the bore 18, for example, by frictional fit between the wick 30 and bore 18 or by an adhesive, among other things.

The wick holder 10 preferably rests with the holder bottom 19 supported on container floor 22. In such cases, the candle 50 may be formed by inserting wick 30 through bore 18 and placing wick holder 10 on the floor 22 of the container 20. The wick holder 10 can be secured in place on the container floor 22, such as with a small amount of adhesive or a tacky candle fuel material. Then, liquid candle fuel 100 is poured into the container 20 around the wick holder 10 and wick 30 until the top surface 105 of the candle is at a desired level, and the wick 30 still protrudes from the top surface 105. The candle fuel 100 is allowed to solidify around the wick 30 in the container 20 before it is used by lighting the wick 30.

The wick holder is preferably made of a polyethersulfone, such as RADEL polyethersulfone sold by BP AMOCO. The polyethersulfone selected must have a UL-94 flammability test rating of at least V-0 or better. It has been found that polyethersulfone used for the wick holder 10 material causes a flame on a candle wick 30 to extinguish when the wick 30 and candle fuel 100 reach the horizontal top surface 16 of the wick holder 10. The polyethersulfone does not support sustained combustion, so the candle flame cannot be sustained when the wick 30 is deprived of candle fuel 100 by the presence of the wick holder 10.

The sloped upper surface 12, when present, may be formed at any angle between 0° and 90°. When the upper surface 12 is at 0° or 90° it is either merged into the horizontal top surface 16 or the vertical side of base 14, respectively. Similarly, the horizontal top surface 16 around bore 18 may be eliminated (see FIG. 8A), so that the sloped upper surface 12 provides a conical shape to the top of the wick holder 10. The sloped surface 12 helps drain molten candle fuel 100 away from the wick 30 so that it cannot fuel the candle flame. Preferably, the sloped surface 12 is present and ranges between a 5° and 30° angle with a horizontal plane.

The polyethersulfone wick holder 10 acts as a heat sink as well, to disperse heat from the burning candle flame away from the area immediately around the candle flame to reduce the size of the molten fuel puddle produced when the flame is at or near the level of the wick holder.

FIGS. 4–9 illustrate alternate shapes for the wick holder 10.

Figure 4:
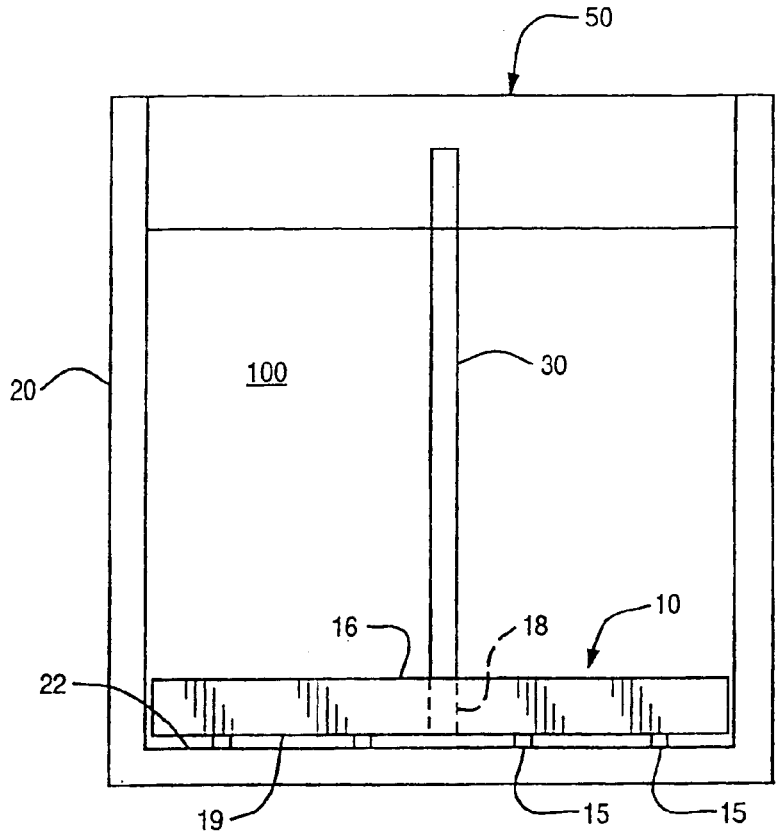
FIG. 4 is a partial sectional side elevation view of an alternative embodiment of the candle and wick holder of FIG. 2.
Figure 5:
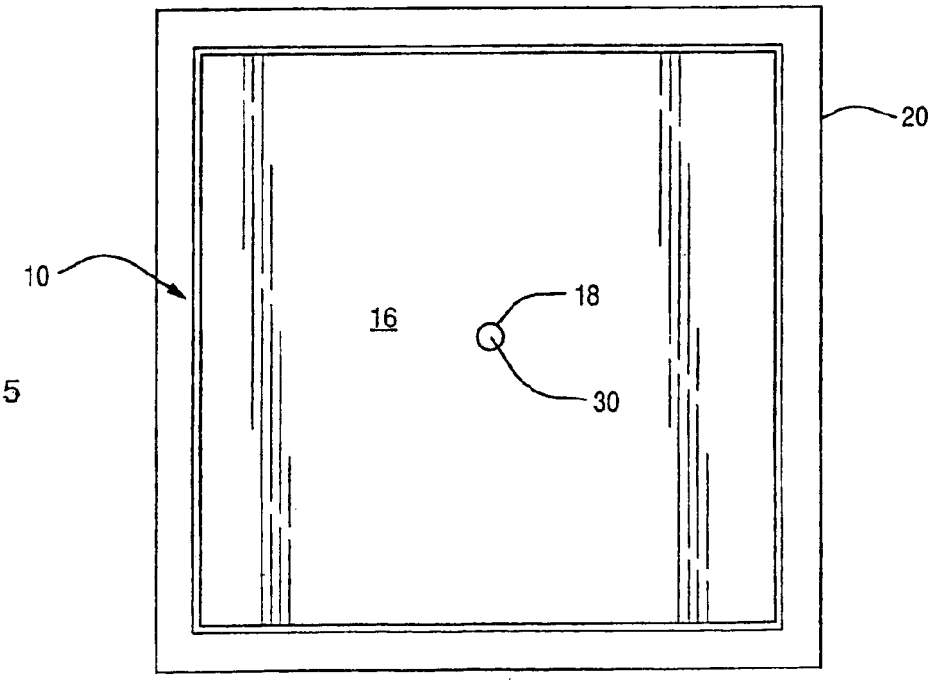
FIG. 5 is a sectional top plan view of the wick holder of FIG. 4.

The wick holder 10 in FIGS. 4 and 5 has a square shape with only a planar top surface 16. The wick holder 10 extends across substantially the entire width between the walls of the container 20. In this embodiment, the container 20 has a square shape and the wick holder 10 is square as well to conform to the container 20 shape. The wick holder 10 has several legs 15 on which bottom surface 19 can be supported above the floor 22 of the container. Bore 18 is preferably provided in about the center of the wick holder 10.

Figure 6:
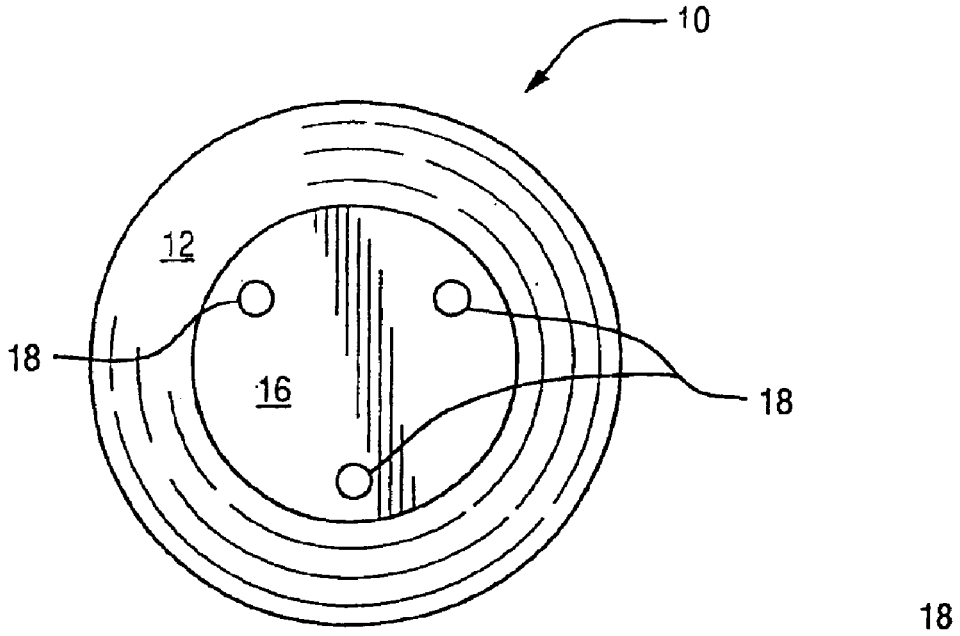
FIG. 6 is a top plan view of yet another embodiment of a candle and wick holder of the invention.
Figure 7:
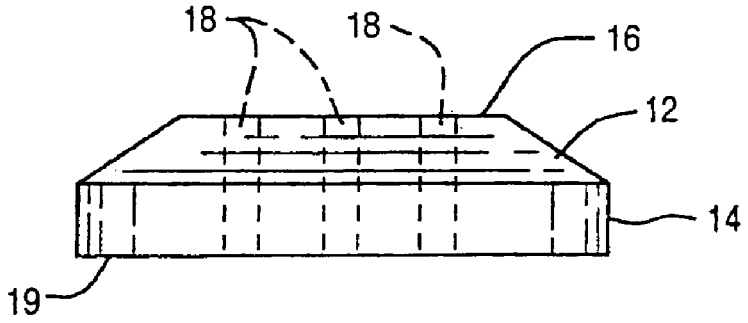
FIG. 7 is a side elevation view of the wick holder of FIG. 6.

FIGS. 6 and 7 illustrate an embodiment of the wick holder 10 for use with multiple-wick candles. The wick holder has three bores 18 for each holding a separate wick. The bores 18 are spaced around the horizontal upper surface 16 to define a triangle. The wick holder 10 has a sloped upper surface 12 around the horizontal top surface 16.

Figure 8A:
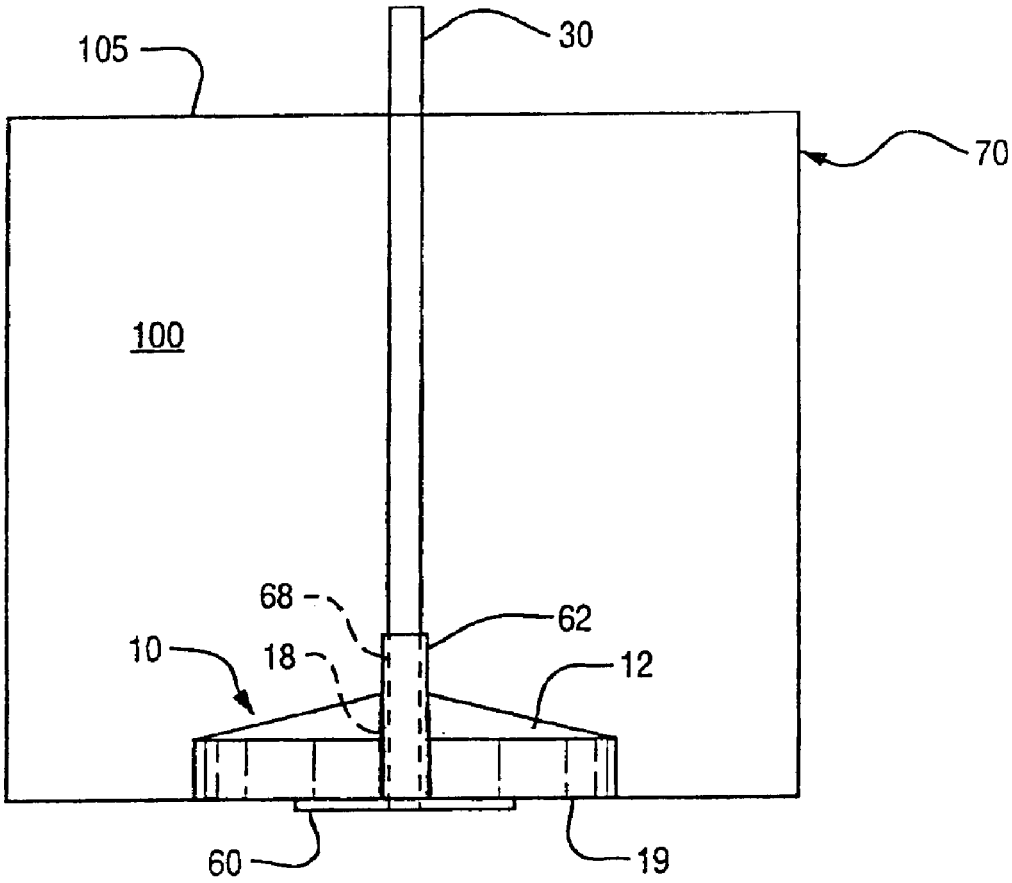
FIG. 8A is a partial sectional side elevation view of a pillar candle with a further embodiment of a wick holder according to the invention.

FIG. 8A shows a pillar candle 70 made from candle fuel 100 and having a wick 30 extending above candle top surface 105. The wick 30 extends downwardly through the candle fuel 100 where it is secured in a wick clip 60 inserted through the bore 18 of wick holder 10. The wick clip 60 may be of the type used in prior art candles to hold the wick in place. The wick 30 is crimped into tube 62, which defines clip bore 68 surrounding wick 30. The base of the wick clip 60 may be exposed outside the candle fuel 100 or slightly encased within the fuel 100 against the holder bottom 19.

Figure 8B:
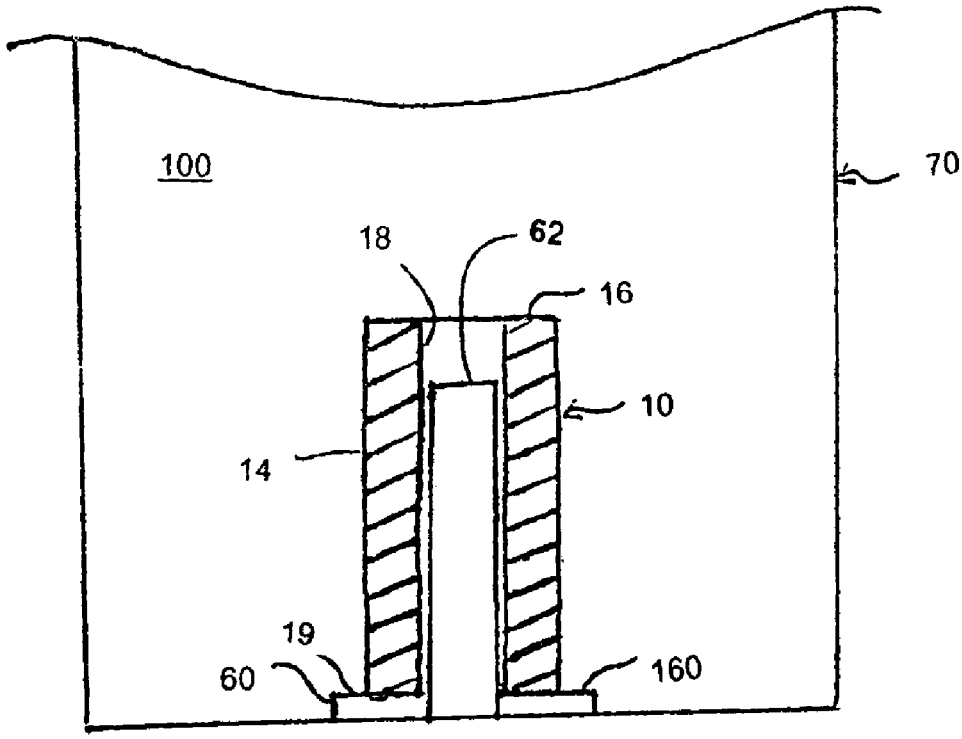
FIG. 8B is a sectional side elevation view of a pillar candle illustrating an alternative embodiment of the wick holder of FIG. 8A.
Figure 8C:
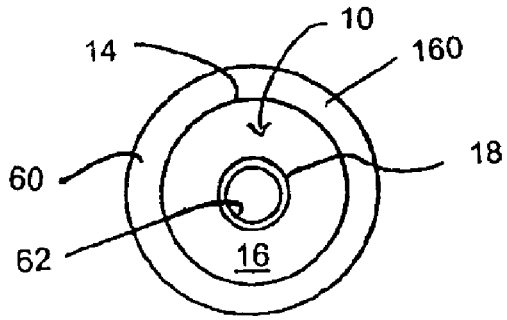
FIG. 8C is a top plan view of the wick holder and clip of FIG. 8B.

FIGS. 8B & 8C illustrate a further embodiment of a wick holder 10 of the invention for use with a pillar, or non-filled, candle 70 and wick clip 60. The wick holder 10 in FIGS. 8B & 8C is cylindrical and extends above the top end of the wick clip 60. The wick holder 10 and wick clip 60 are preferably both embedded within the lower end of candle 70, or extend only slightly. The stability of the candle 70 will be adversely affected by the wick clip 60 or wick holder 10 protruding outwardly beyond the bottom of the fuel 100 in a pillar-type candle 70.

The cylindrical wick holder 10 of FIGS. 8B and 8C has vertical base sides 14 and planar top 16. The bottom edge 19 of the cylindrical wick holder 10 rests on the upper surface of disc portion 160 of wick clip 60. The cylindrical wick holder 10 fits over the tube 62 like a sleeve. Top 16 should at least be the same height or, preferably, rise above the upper end of tube 62 by at least a short distance, for example 1/16 inch or more. That is, the wick holder 10 should be the same length or longer than tube 62. The cylindrical holder 10 is preferably at least 0.25 inches high, as typical wick clips 60 do not have tubes 62 greater than 0.25 inches high.

Wick holder 10 preferably has an inner diameter of bore 18 sized to fit snugly around the tube 62 with a frictional fit or slightly looser. Preferably, the inner diameter of the bore 18 and the outer diameter of the tube are the same so as to provide a snug frictional fit. Non-flammable adhesives are preferably used to secure the wick holder 10 and tube 62 together, or less desirably they may be left separable from each other. The outer diameter of the wick holder 10 is preferably about 0.25 inches or greater, and most preferably is sized from 0.25 inches up to the diameter of the wick clip disc portion 160.

Typically, the wick clip tube 62 will be about the same diameter as the wick used. The wick 30 (not shown in FIG. 8B or 8C) is either crimped in tube 62 or secured to the wick clip 60 by other known means, such as with adhesives. Thus, the cylindrical wick holder 10 will preferably have a tight fit around both the tube 62 and the wick 30.

The cylindrical shape of the wick holder 10 in FIGS. 8B & 8C is better adapted for use in pillar-type candles 70. Wick holders 10 with sloped surfaces 12 are more difficult to retain in the base of such candles, because of the sloped surface shape and lack of a surrounding container. The cylindrical holder 10 and wick clip 60 are more easily embedded in the bottom of a pillar candle 70 and safely held until the candle fuel 100 is consumed to the end of its useful life.

Although the cylindrical wick holder 10 generally will not protect against secondary wicking, this has been found to be less of a problem with pillar candles. The cylindrical wick holder 10 functions to extinguish the candle flame and cut off the flow of candle fuel 100 on the wick 30 when the flame nears the upper end of wick holder 10. This capability is improved when the wick holder 10 extends above the tube 62.

Figure 9:
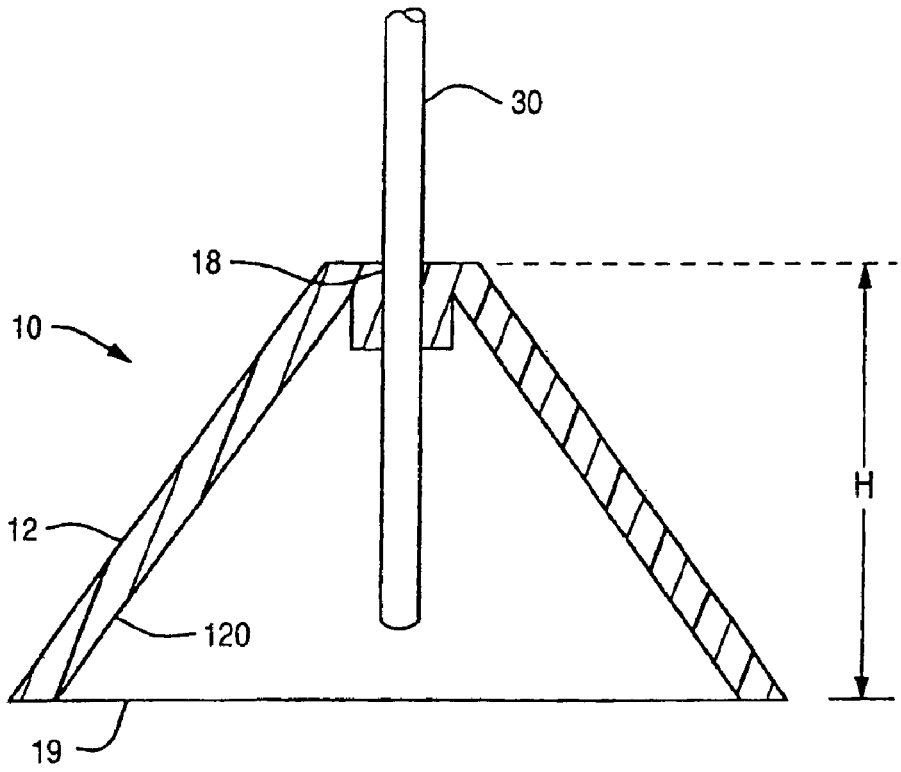
FIG. 9 is a sectional side elevation view of yet another embodiment of a wick holder of the invention.
Figure 10:
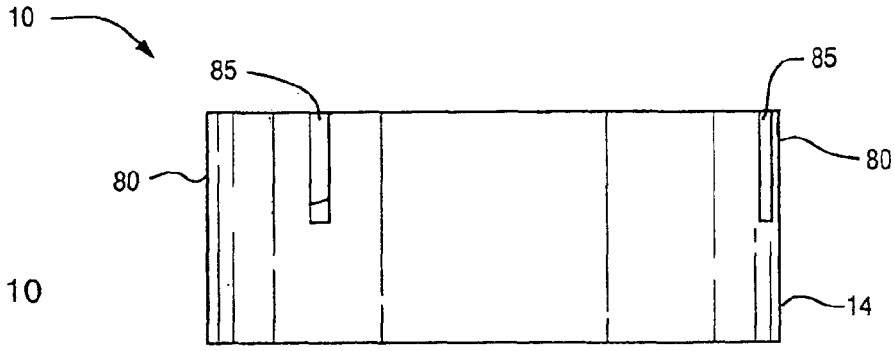
FIG. 10 is a side elevation view of a fifth embodiment of a wick holder according to the invention.
Figure 11:
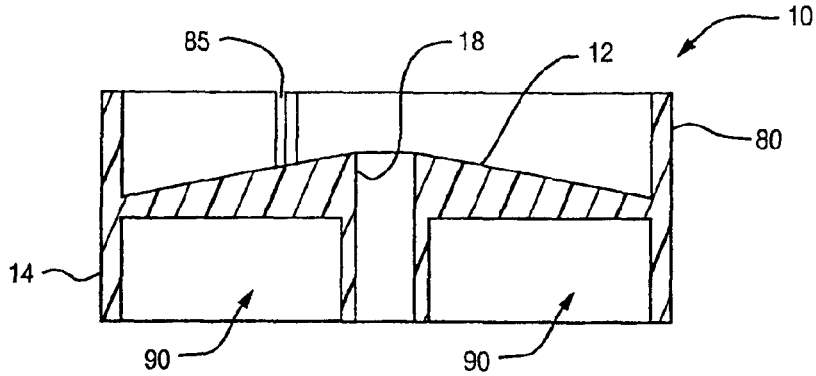
FIG. 11 is a sectional side elevation view of the wick holder of FIG. 10.
Figure 12:
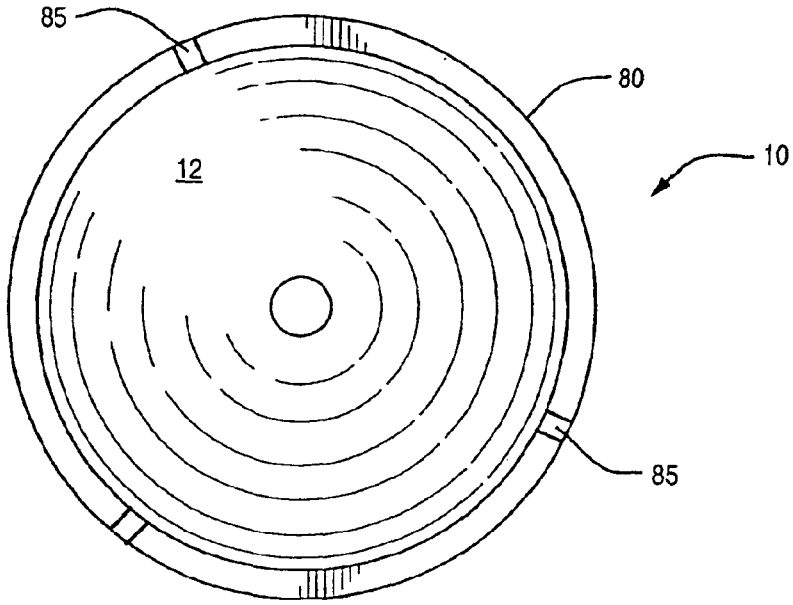
FIG. 12 is a top plan view of the wick holder of FIG. 10.
Figure 13:
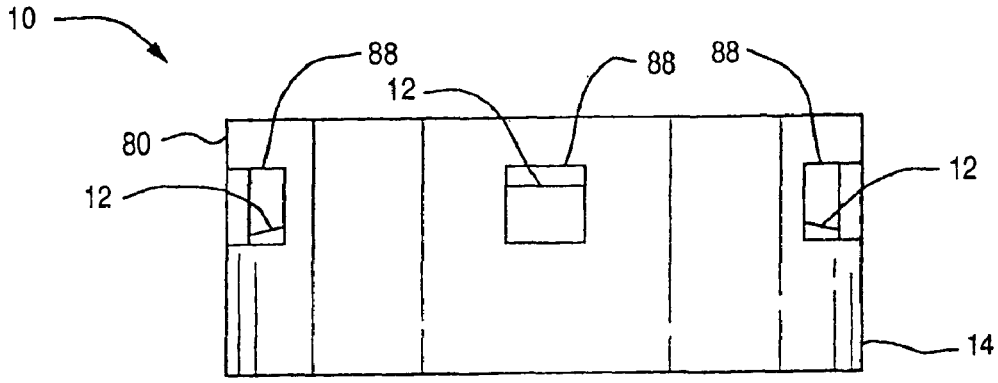
FIG. 13 is a side elevation view of an the wick holder of FIG. 10 with an alternative barrier drain.
Figure 14:
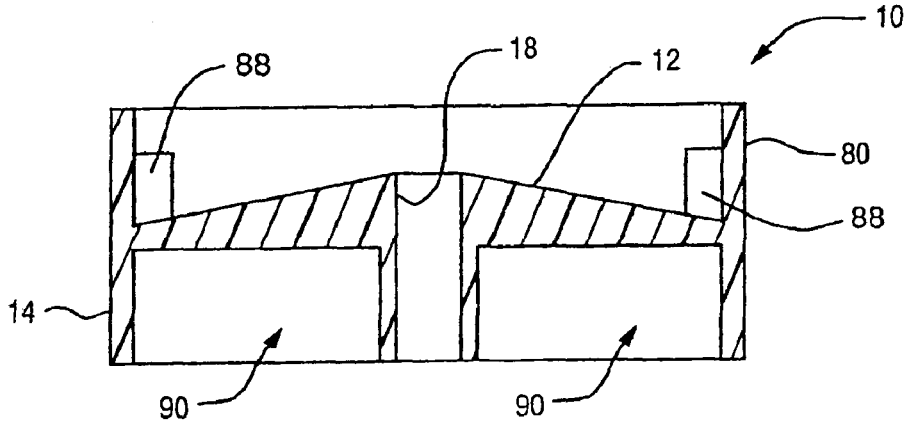
FIG. 14 is a sectional side elevation view of the wick holder of FIG. 13.

FIG. 9 illustrates an embodiment of the wick holder 10 which is formed as a hollow cone or cap. The outer sides of the wick holder 10 are formed by sloped surface 12, which taper from the bottom edge surface 19 to the bore 18 at the top. Since the holder 10 is hollow, a corresponding inner sloped side 120 is formed opposite the sloped surface 12. A wick 30 is inserted through bore 18 and held by a frictional fit or adhesive. When the wick holder 10 is a hollow cone as shown in FIG. 9, it is very easy to make by injection molding using polyethersulfone.

The cone-shaped holder of FIG. 9 is preferably at least about ½ inch in diameter at bottom edge surface 19 and most preferably at least about 1 inch in diameter or greater. The height H of the wick holder 10 should be at least about ⅛ inch, and is preferably between about ¼ inch and 1 inch. The thickness of the holder 10 between sloped surface 12 and inner sloped side 120 should be at least about 1/32 inch or greater.

FIGS. 10–14 illustrate a further embodiment of the wick holder 10 in which a vertically extending barrier 80 is provided all around the circumference of the holder 10. The barrier 80 is provided with either grooves 85 (FIGS. 10–12) or through holes 88 (FIGS. 13, 14) for draining molten wax or other fuel off the wick holder sloped surface 12. The wick holder 10 may have cavities 90 in the base to reduce the amount of material required to make the holder 20. The thicknesses of the walls defining the cavity 90 should not be less than about 1/32 inch.

The wick holder 10 should have the same dimensions as discussed above, except that the holder 10 includes the circumferential barrier 80 extending above cylindrical base portion 14. The barrier preferably extends above the base portion 14 by between ⅛ inch to ½ inch. The remaining dimensions of the wick holder 10 may be the same as in other embodiments.

The barrier 80 prevents a wick 30 from falling over into fuel surrounding the holder 10 and creating a secondary wicking effect. The barrier is preferably located at the perimeter edge of the wick holder 10, although it may be positioned closer to the bore 18 when the wick holder 10 diameter is large. It should be understood that the wick holder 10 can be shaped as in any of the prior embodiments and the barrier 80 will be positioned at the same perimeter edge as shown with the circular wick holder 10 of FIGS. 10–14.

When a candle has burned down sufficiently that the wick holder 10 is needed to help prevent flashover from occurring, the barrier 80 will support a leaning wick above the surrounding fuel. As shown in FIGS. 10, 11, 13, and 14, the barrier 80 is preferably higher than the upper end of the sloped surface 12 of the holder 10 where bore 18 is located. Alternatively, the barrier 80 will retain the burning end of the wick on the top sloped surface 12 of the holder 10 until it is safely extinguished.

The grooves 85 and drain holes 88 are provided so that as the candle burns down toward the sloped surface 12 of the wick holder 10, the fuel covering the holder 10 can drain off the sloped surface 12. When grooves 85 are used, each groove 85 should have a width less than the width of the wick (and bore 18). The narrower grooves 85 will prevent the wick from being able to fall into one of the grooves 85 and onto fuel surrounding the wick holder 10. The drain holes 88 may be any size, but are preferably narrower or shorter than the diameter of a wick used with the holder 10 to prevent the wick from passing through one of the drain holes 88. The grooves 85 or drain holes 88 should not be smaller than 1/32 inch wide, so that fuel will drain effectively off the sloped surface 12.

The sloped surface 12 can be arranged at any angle from 0–90°, relative to horizontal. When the wick holder 10 includes barrier 80, the sloped surface 12 is preferably angled at between 1–10°, and most preferably about 4° relative to horizontal.

The drain holes 88 or grooves 85 are spaced around the circumference of the barrier 80. Preferably, they are spaced equidistant from each other. They may be used in combination as well, so that a groove 85 is provided at one point of the barrier 80, while a drain hole 88 is provided 180° opposite.

At least one groove 85 or drain hole 88 is needed to ensure that fuel will have a path for flowing off the sloped surface 12. Preferably, there are three grooves 85 or drain holes 88, and most preferably, the three openings are arranged spaced 120° apart around the barrier 80.

Figure 15:
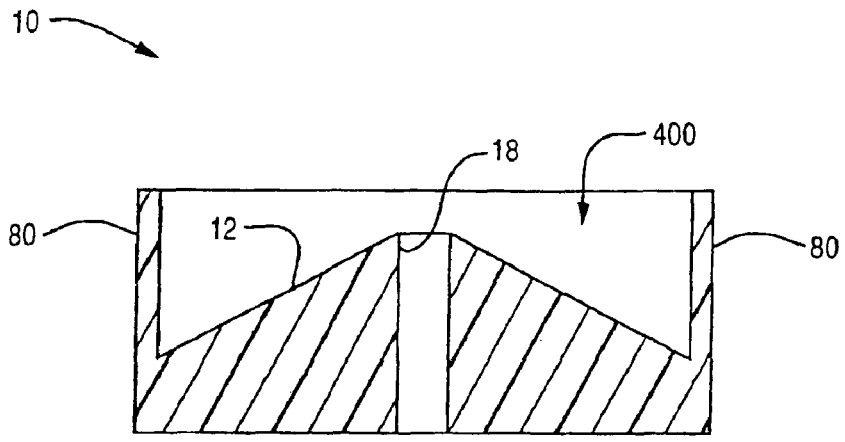
FIG. 15 is a sectional side elevation view of a sixth embodiment of a wick holder according to the invention.
Figure 16:
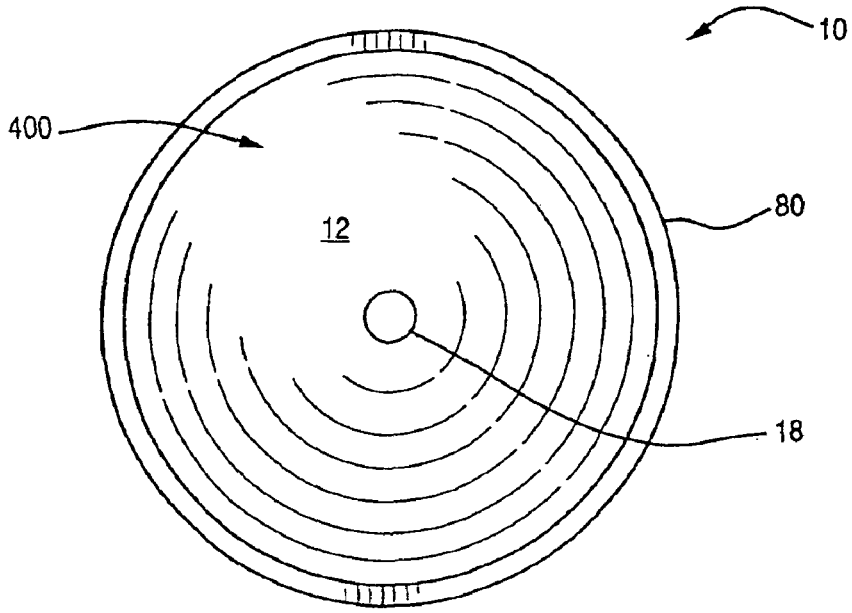
FIG. 16 is a top plan view of the wick holder of FIG. 15.

In yet another embodiment of the wick holder 10 illustrated by FIGS. 15–18, the barrier 80 lacks drain holes and forms a reservoir 400 around bore 18. FIG. 15 shows the wick holder having a sloped surface 12 which slopes downwardly from bore 18 toward barrier 80. FIG. 16 displays the arrangement of the bore 18 relative to the sloped surface 12 and barrier 80.

Figure 17:
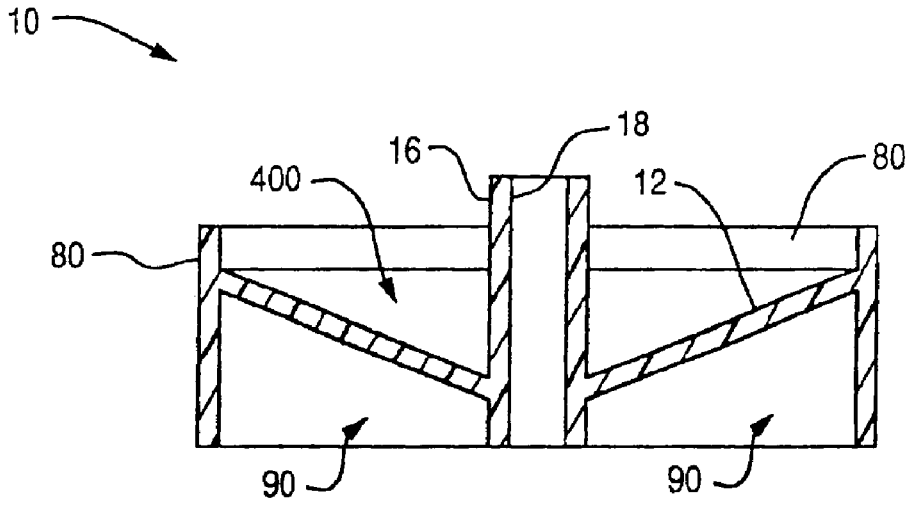
FIG. 17 is a sectional side elevation view of an alternate reservoir of the wick holder of FIG. 15.

FIG. 17 illustrates a sloped surface 12 which is angled with the reverse slope to that of the wick holder 10 of FIG. 15. In FIG. 17, the bore 18 of wick holder 10 extends above sloped surface 12, so that the reservoir 400 is deepest immediately adjacent the bore 18. As shown, the bore 18 can extend above the edge of barrier 80, so that even if the wick (not shown in FIG. 17) falls over, there is additional distance between the wick and molten wax in the reservoir 400.

The wick holder 10 may have cavities 90 in the embodiments of FIGS. 15–18, as shown in FIG. 17, as well to reduce the material needed to make the wick holder 10.

Figure 18:
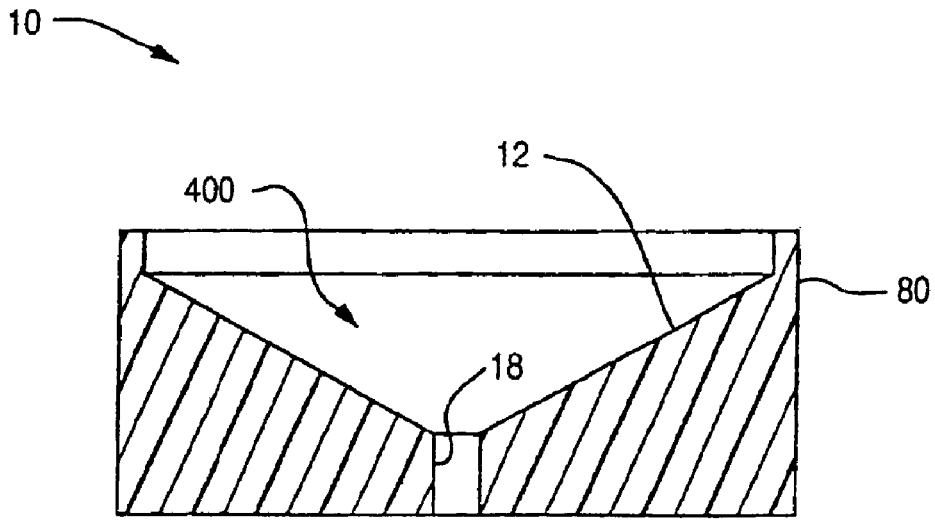
FIG. 18 is a sectional side elevation view of a second alternate reservoir of the wick holder of FIG. 15.

FIG. 18 shows the wick holder 10 with the same reverse slope of sloped surface 12, so that reservoir 400 resembles a bowl, with bore 18 at the bottom center. This embodiment reduces the size of the molten wax pool at the end of the candle useful life surrounding the wick (not shown).

The embodiment of the wick holder 10 of FIGS. 15–18 is particularly useful with large-diameter candles. Melted wax pools within the reservoir 400 when the candle has burned down to the wick holder 10. But, wax outside the barrier 80 is prevented from continuing to feed wick 30. Thus, when the wax in the reservoir 400 is consumed below the level of bore 18, the candle will be extinguished. In the case of a large-diameter candle, when the barrier 80 has a significantly smaller diameter, it reduces the amount of pooled wax available to the wick 30 at the end of the candle useful life to only that pool of wax contained in the reservoir 400.

The embodiments of the wick holder 10 having a barrier 80 are particularly useful for preventing secondary wicking. Secondary wicking occurs when fuel is drawn up from the wax pool through the free upper end of the wick. If all of the wax pool is drawn up this way then it is possible to increase the wax pool temperature above its flash point and/or in a filled candle to break/shatter the candle holder. To help prevent secondary wicking it is preferable to make the wick holder 10 about 1.5 inches diameter so that it is wide enough to prevent the free end of the wick from touching the wax pool. The barrier 80 provides an elevated support if the upper end of the wick does fall over, and can prevent it from touching the pool.

Polyethersulfone (PES) is a preferred material for making the wick holder 10 for several reasons. PES is a thermoplastic capable of withstanding elevated temperatures. This characteristic allows PES to be easily molded using injection molding techniques. PES is resistant to acids, bases, aliphatic hydrocarbons, oils and fat, among other things, so that it is unlikely to absorb fragrance oils or candle fuels which might make the wick holder 10 somewhat combustible.

Polyethersulfone melts at about 230° C. (about 446° F.). It has a Vicat softening point of about 215° C. (419° F.). A very favorable feature of polyethersulfone is that it is intumescent. That is, when PES is heated, such as by a candle flame, it begins to swell, which in the region of the bore 18, acts to cut off the capillary action in the wick.

Further, PES can appear transparent to yellowish, so that it is usable in transparent candles.

PES is substantially non-combustible, having a UL-94 standard vertical burn test rating of V-0 for thicknesses as small as 1/32 inch. The resistance to combustion of PES combined with heat dissipation properties of a sufficiently large wick holder 10 results in a wick holder according to the invention being capable of extinguishing a candle flame when the flame reaches the level of the wick holder upper surface.

Several tests were conducted with different size wick holders made from PES in accordance with the invention to verify the ability of the wick holders to extinguish a candle flame. The test samples and results were as follows.

Test 1

Three cylindrical paraffin wax candles and three cylindrical candles made from UNICLEAR each having a PES wick holder 3/8 inches in total height, with a 10° slope to the sloped upper surface 12, 3/32 inch diameter bore 18 and one inch diameter across were provided. The candles were burned 12 hours per day until the candle was at the end of its useful life. The candles were each monitored to determine if they extinguished on their own at the end of the candle useful life. In particular, the candles were monitored to determine if they self-extinguished once the top surface of the PES wick holder 10 was exposed, or alternatively, if secondary wicking occurred, such as from carbon ball buildup or wick pieces in the residual candle fuel. It was observed that all six candles extinguished upon reaching the PES wick holder, despite the presence of carbon balls adjacent the wick. The width of the PES wick holder prevented wick pieces from causing any secondary wicking.

Test 2

Three cylindrical paraffin wax candles and three cylindrical candles made from UNICLEAR each having a PES wick holder 3/8 inches in total height, with a 10° slope to the sloped upper surface 12, 5/32 inch diameter bore 18 and one inch diameter across were provided. The candles were burned and observed as in Test 1, above. Again, all six candles self-extinguished despite the presence of carbon balls and some small wick pieces which were trapped on the sloped upper surface of the wick holder and prevented from igniting any candle fuel. The PES holder did not experience any combustion.

Test 3

Three cylindrical paraffin wax candles and three cylindrical candles made from UNICLEAR each having a PES wick holder 3/8 inches in total height, with a 20° slope to the sloped upper surface 12, 3/32 inch diameter bore 18 and one inch diameter across were provided. The candles were burned and observed as in Test 1, above. All six candles self-extinguished.

Test 4

Three cylindrical paraffin wax candles and three cylindrical candles made from UNICLEAR each having a PES wick holder 3/8 inches in total height, with a 20° slope to the sloped upper surface 12, 5/32 inch diameter bore 18 and one inch diameter across were provided. The candles were burned and observed as in Test 1, above. All six candles self-extinguished.

Test 5

Three cylindrical paraffin wax candles and nine cylindrical candles made from UNICLEAR each having a PES wick holder ¼ inches in total height, with a 10° slope to the sloped upper surface 12, 5/32 inch diameter bore 18 and one inch diameter across were provided. The candles were burned and observed as in Test 1, above. All but one of the candles self-extinguished despite the presence of carbon balls and wick pieces.

Test 6

Three cylindrical paraffin wax candles and three cylindrical candles made from UNICLEAR each having a PES wick holder ¼ inches in total height, with a 20° slope to the sloped upper surface 12, 3/32 inch diameter bore 18 and one inch diameter across were provided. The candles were burned and observed as in Test 1, above. All six candles self-extinguished.

Test 7

Three cylindrical paraffin wax candles and two cylindrical candles made from UNICLEAR each having a PES wick holder ¼ inches in total height, with a 20° slope to the sloped upper surface 12, 5/32 inch diameter bore 18 and one inch diameter across were provided. The candles were burned and observed as in Test 1, above. All five candles self-extinguished.

In each of the tests above, a 44-32-18c wick from Atkins and Pierce was used.

As shown by the tests, a relatively small wick holder 10 incorporated into a candle can provide a self-extinguishing feature. Preferably, the wick holders 10 will be at least 1 inch in diameter, up to the diameter of the container or candle the wick holder is used with. The wick holders can be between 1/32 inch thick to 1 inch or more, but are preferably about 3/32 to ½ inch thick between the bottom surface 19 and horizontal top surface 16 or top opening of the bore 18 when there is no top surface 16. The wick holders 10 should position the top opening of the bore 18 at about ⅛ inch above the bottom of the candle or container bottom 22, and preferably between about ¼ inch and 1 inch above the container bottom 22 or candle bottom.

Other polymers having similar properties to PES can be used for the wick holder 10. In particular, the polymer must not support combustion by a candle flame. Polymers which have at least a V-0 rating for sample thicknesses of 1/32 to ⅛ inch from the UL-94 test are good candidates. Other materials having a UL-94 test rating of V-0 for the same thicknesses may be used as well, including ceramics. Preferably the V-0 rating can be obtained for material thicknesses as low as 1/32 inch, but materials rated V-0 at thicknesses up to ¼ inch are acceptable.

Preferably, the material selected for the wick holder 10 will also be intumescent when heated, so that the same constriction effect in the bore 18 is provided when the candle flame reaches the top surface 16 of the wick holder 10.

Acceptable polymers include polyphenylsulfones (PPS) and polyvinylchloride (PVC) which meet the non-combustion and intumescent requirements, will not melt at temperatures less than about 350° F. and can also be easily injection molded. Specific polymers include RADEL A-300, polysulfone P-1720 (pigmented) and polysulfone P-1700, available from Amoco.

As a further alternative, ceramics which are heat resistant and do not support combustion could be used for the wick holder 10. Although ceramics will not usually have the same intumescent properties as the preferred polymers, the heat resistant and non-combustible nature of ceramics at the temperatures involved with burning candles make them suitable for use.

A further alternative composition for making the wick holder 10 of the invention is one known commercially as FX-100 sold by Flame Seal. The composition is formable into any of the wick holder shapes of FIGS. 2–18. But, the composition does not support combustion.

While a specific embodiment of the invention has been shown and described in detail to illustrate the application of the principles of the invention, it will be understood that the invention may be embodied otherwise without departing from such principles.

What is claimed is:

1. A wick assembly for a candle having a wick, the candle made from a fuel capable of melting to form a liquid pool and traveling by capillary action to a flame burning on the wick, the wick assembly comprising:

a wick clip holding one end of the wick inside a tube having an upper end, the wick extending from the upper end;

a sleeve having a top end, a bottom end, a side wall connecting the top end to the bottom end, and a bore through the sleeve for fitting around the tube and the wick, the sleeve top end positioned adjacent or extending past the tube upper end, the sleeve being made from a non-combustible material selected from the group consisting of polyethersulfone and polyvinylchloride.

2. A wick assembly according to claim 1, wherein the sleeve is frictional fit to the tube.

3. A wick assembly according to claim 1, wherein the sleeve is cylindrical.

4. A wick assembly according to claim 3, wherein the sleeve diameter is about 0.25 inches.

5. A wick assembly according to claim 4, wherein the wick clip further comprises a disc shaped portion connected to the tube adjacent the one end of the wick.

6. A wick assembly according to claim 1, wherein the sleeve is fixed to the wick clip by an adhesive.

7. A wick assembly according to claim 1, wherein the top end of the sleeve extends past the tube upper end.

8. A wick assembly according to claim 7, wherein the top end extends past the tube upper end at least 0.125 inches.

9. A self-extinguishing candle, comprising:

a wick clip holding one end of a wick inside a tube having an upper end, the wick extending from the upper end;

a sleeve having a top end, a bottom end, a side wall connecting the top end to the bottom end, and a bore through the sleeve for fitting around the tube and the wick, the sleeve top end positioned adjacent or extending past the tube upper end, the sleeve being made from a non-combustible material selected from the group consisting of polyethersulfone and polyvinylchloride;

a candle fuel surrounding the sleeve, the wick extending through the candle fuel so that at least a portion of the wick is exposed above the candle fuel for lighting to melt the candle fuel adjacent the wick, the sleeve extinguishing a flame burning on the wick when the flame reaches the top surface of the sleeve.

10. A self-extinguishing candle according to claim 9, wherein the sleeve is frictional fit to the tube.

11. A self-extinguishing candle according to claim 9, wherein the sleeve is cylindrical.

12. A self-extinguishing candle according to claim 11, wherein the sleeve diameter is about 0.25 inches.

13. A self-extinguishing candle according to claim 12, wherein the wick clip further comprises a disc shaped portion connected to the tube adjacent the one end of the wick.

14. A self-extinguishing candle according to claim 11, wherein the candle fuel forms a pillar candle.

15. A wick assembly according to claim 9, wherein the sleeve is fixed to the wick clip by an adhesive.

16. A wick assembly according to claim 9, wherein the top end of the sleeve extends past the tube upper end.

17. A wick assembly according to claim 16, wherein the top end extends past the tube upper end at least 0.125 inches.

18. A self-extinguishing candle according to claim 9, wherein the candle fuel forms a pillar candle.

* * * * *

UNITED STATES PATENT AND TRADEMARK OFFICE

CERTIFICATE OF CORRECTION

PATENT NO. : 6,923,639 B2
DATED : August 2, 2005
INVENTOR(S) : Bradley D. Pesu et al.

It is certified that error appears in the above-identified patent and that said Letters Patent is hereby corrected as shown below:

Title page,
Item [73], Assignee, should read -- Bath & Body Works, Inc.
Reynoldsburg, OH (US) --.

Signed and Sealed this

Twenty-seventh Day of September, 2005

JON W. DUDAS
*Director of the United States Patent and Trademark Office*